US007594531B2

(12) United States Patent
Hirata et al.

(10) Patent No.: US 7,594,531 B2
(45) **Date of Patent: *Sep. 29, 2009**

(54) MOLDING MACHINE

(75) Inventors: Minoru Hirata, Toyokawa (JP); Takayuki Komiyama, Toyokawa (JP); Toshihiko Oya, Toyokawa (JP); Tsuyoshi Sakai, Toyokawa (JP); Koichi Sakaguchi, Toyokawa (JP)

(73) Assignee: Sintokogio, Ltd., Aichi (JP)

( * ) Notice: Subject to any disclaimer, the term of this patent is extended or adjusted under 35 U.S.C. 154(b) by 140 days.

This patent is subject to a terminal disclaimer.

(21) Appl. No.: 11/826,135

(22) Filed: Jul. 12, 2007

(65) Prior Publication Data

US 2008/0138457 A1 Jun. 12, 2008

(30) Foreign Application Priority Data

Dec. 6, 2006 (JP) ..... 2006-329071
May 18, 2007 (JP) ..... 2007-132330

(51) Int. Cl.
*B22C 15/08* (2006.01)
*B22D 46/00* (2006.01)

(52) U.S. Cl. ..... 164/151; 164/155.3; 164/154.8; 164/207

(58) Field of Classification Search ..... 164/456, 164/29, 151, 155.3, 154.8, 207
See application file for complete search history.

(56) References Cited

U.S. PATENT DOCUMENTS 4,411,303 A * 10/1983 Shioda ..... 164/182

FOREIGN PATENT DOCUMENTS

| | | | |
|---|---|---|---|
| EP | 1 208 928 | A9 | 5/2002 |
| EP | 1 695 776 | A1 | 8/2006 |
| EP | 1 726 382 | A1 | 11/2006 |
| JP | 4-274838 | | 9/1992 |
| WO | WO 2005/058528 | A1 | 6/2005 |

* cited by examiner

*Primary Examiner*—Kuang Lin
(74) *Attorney, Agent, or Firm*—Finnegan, Henderson, Farabow, Garrett & Dunner, L.L.P.

(57) ABSTRACT

A hydraulic power unit 15 of a match-plate molding machine comprises a hydraulic pump 20 for supplying oil, a piping system 21, 25, and 26 that fluidly communicates with first and second hydraulic cylinder systems 7 and 10 for supplying the oil from the hydraulic pump 20 to them to perform a squeeze step, an accumulator 22 that is provided within the piping system, first and second electromagnetic directional control valves 23 and 24 for controlling the flow of the oil from the hydraulic pump 20 to the first and second hydraulic cylinder systems 7 and 10, first and second pressure sensors 27 and 28 for measuring pressures of the oil of the first and second hydraulic cylinder systems 7 and 10, and for generating output signals that correspond to the measured value, and a controller 29 for receiving the output signals from the first and second pressure sensors 23 and 24, and for controlling the turns of the first and second electromagnetic directional control valves 23 and 24 based on the output signals and the predetermined value within a range below the pressure holding the accumulator 22 against the oil.

3 Claims, 3 Drawing Sheets

MOLDING MACHINE

FIELD OF THE INVENTION

Figure 1:
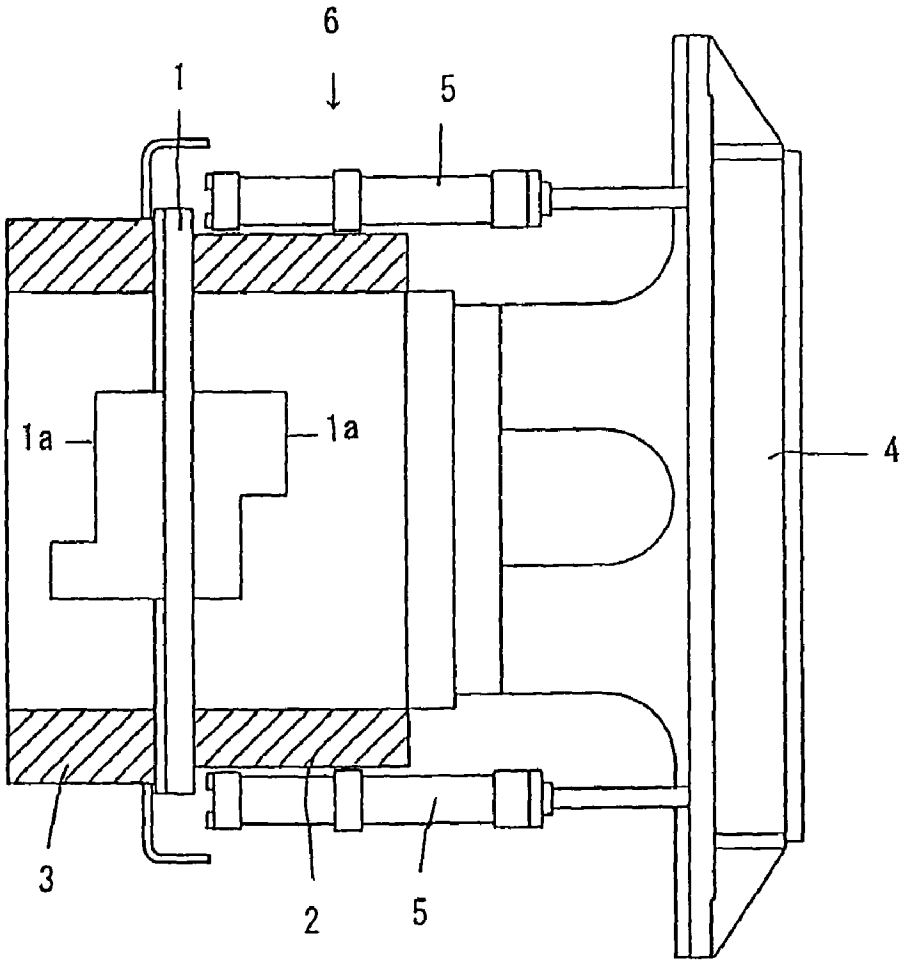

This invention relates to a molding machine, and, more particularly, to the improvement of a hydraulic power unit in a match-plate molding machine.

BACKGROUND OF THE INVENTION

One example of a conventional match-plate molding machine is disclosed in the publication WO2005/058528 A1. The disclosed molding machine includes a pair of hydraulic cylinder systems for actuating upper and lower squeeze members, and a hydraulic power unit for energizing these hydraulic cylinder systems. The hydraulic power unit includes a piping system that supplies oil from a hydraulic pump to the pair of hydraulic cylinder systems. The piping system is typically provided with an accumulator in order to reduce the power of a motor that drives the hydraulic pump for supplying the oil, to stabilize a hydraulic circuit, to shorten the period of the cycle, and to buffer the oil.

In such a conventional machine, however, there is an inconvenience in that the minimum value of the pressure of the oil supplied to the pair of the hydraulic cylinder systems cannot be below the holding pressure of the accumulator against the oil when the squeeze members squeeze the molding sand by actuating them as the pair of the hydraulic cylinder systems are extended.

Accordingly, one purpose of the present invention is to provide a match-plate molding machine that causes the value of the oil supplied to a pair of hydraulic cylinder systems that drive a pair of squeeze members to be below the holding pressure of an accumulator against the oil.

SUMMARY OF THE INVENTION

One aspect of the present invention provides a match-plate molding machine. The molding machine comprises: a flask assembly that includes a cope flask, a drag flask, and a changeable match plate, wherein the match plate has top and bottom surfaces on which patterns are formed; an upper squeeze member adapted to be inserted into the flask assembly from the cope flask-side to oppose the top surface of the match plate and for defining an upper molding space, which is to be filled with molding sand, together with the cope flask and the top surface of the match plate; a lower squeeze member adapted to be inserted into the flask assembly from the drag flask-side to oppose the bottom surface of the match plate and for defining a lower molding space, which is to be filled with the molding sand, together with at least the drag flask and the bottom surface of the match plate; a first hydraulic cylinder system for driving the upper squeeze member to the top surface of the match plate to squeeze the molding sand within the upper molding space; a second hydraulic cylinder system for driving the lower squeeze member to the bottom surface of the match plate to squeeze the molding sand within the lower molding space; and a hydraulic power unit for extending the first and second hydraulic cylinder systems.

The molding machine is characterized in that the hydraulic power unit comprises: a source for supplying oil; a piping system that fluidly communicates with the first and second hydraulic cylinder systems so as to supply the oil from the source; an accumulator that is provided within the piping system; first and second electromagnetic directional control valves for controlling the flow of oil from the source to the first and second hydraulic cylinder systems: first and second pressure sensors located in the piping system to associate with the first and second hydraulic cylinder systems for measuring the pressures of the oil within the piping system while the first and second hydraulic cylinder systems are extended, and for generating output signals that correspond to the measured values of the first and second pressure sensors; and a controller for receiving the output signals from the first and second pressure sensors, and for controlling the turning of the first and second electromagnetic directional control valves based on the output signals and the predetermined value within a range below the holding pressure of the accumulator against the oil.

In one embodiment of the present invention, if one pressure sensor of the first and second pressure sensors reaches the predetermined value, the controller controls at least the one corresponding electromagnetic directional control valve to stop the supply of the oil to the one corresponding hydraulic cylinder system. In this case, the controller may also control the other electromagnetic directional control valve to stop the supply of the oil to both the first and second hydraulic cylinder systems.

If the measured values of both the first and second sensors reach the predetermined value, the controller may control both the first and second electromagnetic directional control valves to stop the supply of the oil to both the first and second hydraulic cylinder systems.

If the measured values of the first and second sensors reach the predetermined value, and if the measured value of one pressure sensor is greater than that of the other pressure sensor, the controller may control the one corresponding electromagnetic directional control valve to stop the supply of the oil to the one corresponding hydraulic cylinder system.

In one aspect of the present invention, the controller controls the turns of at least one electromagnetic directional control valve to reactivate the stopped supply of the oil to the one corresponding hydraulic cylinder system, when the measured value from one pressure sensor is below the predetermined value.

Preferably, the type of each of the first and second electromagnetic directional control valves is a 3-position 4-port valve.

The first and second hydraulic cylinder systems may each include one or more cylinders.

BRIEF DESCRIPTIONS OF THE DRAWINGS

Figure 2:
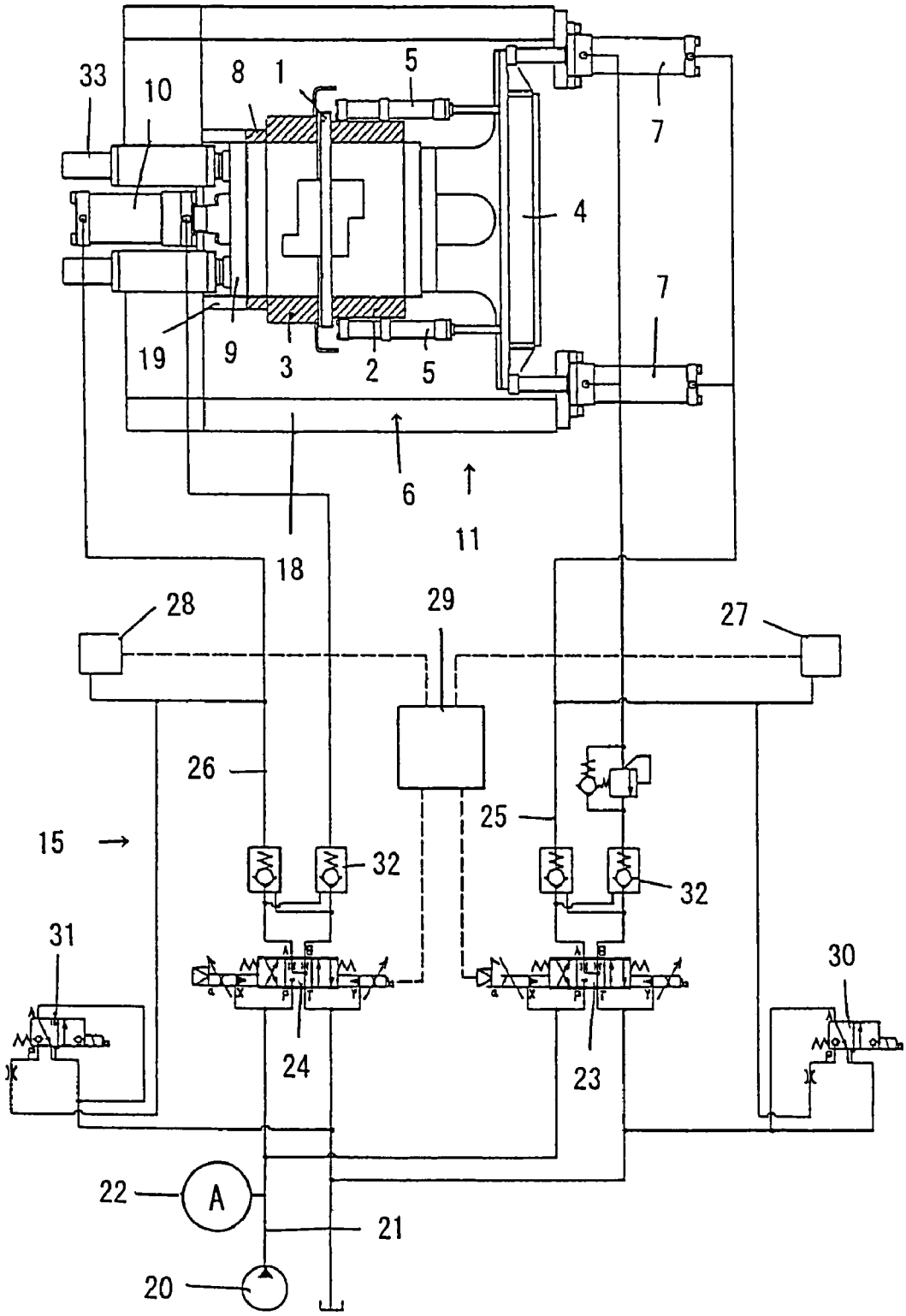
Figure 3:
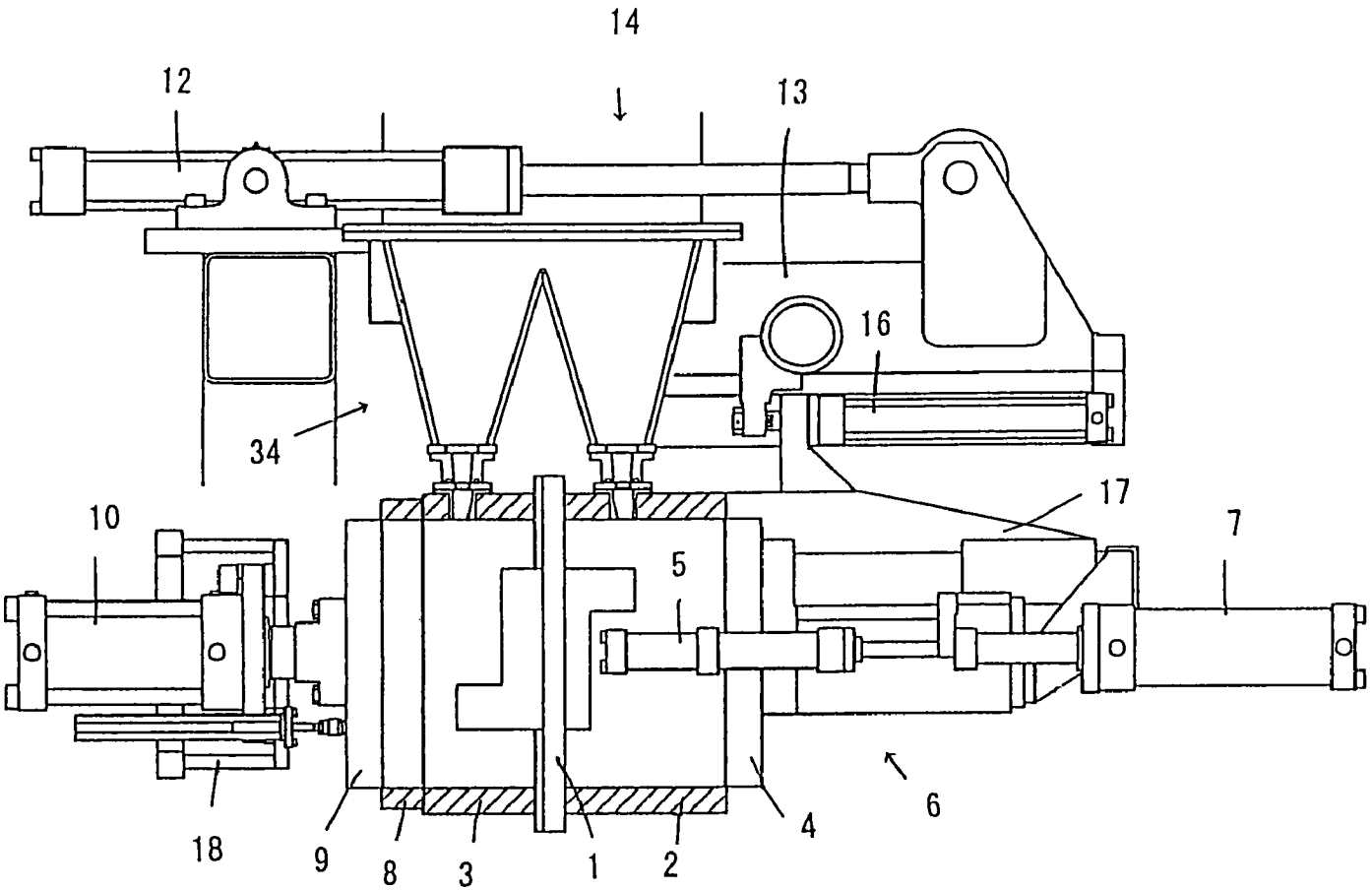

The foregoing and the other purposes and advantages of the present invention are further clarified by the following descriptions, which refer to the accompanying drawings in which:

FIG. 1 schematically illustrates a molding unit of a molding machine of one embodiment of the present invention;

FIG. 2 is a schematic block diagram of the molding unit of the molding machine of one embodiment of the present invention, and illustrates the molding unit of FIG. 1 and its related parts; and FIG. 3 is a front view, partly in cross section, of the molding machine of the embodiment of the present invention.

THE PREFERRED EMBODIMENT OF THE PRESENT INVENTION

FIGS. 1, 2, and 3 illustrate a match-plate molding machine of one embodiment of the present invention. As shown in FIG. 1, the match-plate molding machine includes a molding unit 6 having a flask assembly that comprises a cope flask 2, a drag flask 3, and an exchangeable match plate 1 that is sandwiched and held therebetween. The top and bottom surfaces of the match plate 1 are formed with patterns 1*a*.

The molding unit also includes an upper squeeze member 4 that is adapted to be inserted into an opening (not shown), which is opposed to the match plate 1, of the cope flask 2 of the flask assembly to define a molding space with the top surface of the match plate 1 and the cope flask 2, and two cylinders 5, which are mounted on the front and rear outer sides of the cope flask 2, for pushing away the upper squeeze member 4 from the side of the match plate 1.

As shown in FIGS. 2 and 3, the molding machine also includes a driving system 11. The system includes a first hydraulic cylinder system, or a pair of left-facing, hydraulic cylinders 7 in this embodiment, for driving the upper squeezes member 4 toward the top surface of the match plate 1, and a filling frame 8 and a lower squeeze member 9 that define a lower molding space together with the bottom surface of the match plate 1 and the drag flask 3, a second hydraulic cylinder system, or a single, right-facing hydraulic cylinder 10 in this embodiment, for driving the lower squeezes member 9 toward the bottom surface of the match plate 1. Each first or second hydraulic cylinder system 7 or 10 may comprise one or more hydraulic cylinders. The number of cylinders is not limited in the present invention.

To define the lower molding space, the lower squeeze member 9 is inserted in an opening (not shown), which is opposed to the match plate 1, of the drag flask 3 of the flask assembly.

The molding machine also includes a hydraulic power unit 16 that actuates the pair of the upper hydraulic cylinders (the first hydraulic cylinder system) 7 and the single, lower hydraulic cylinder (the second hydraulic cylinder system) 10.

The molding machine of the illustrated embodiment further includes a pivoting frame 13 that pivotally moves up and down in the vertical plane by extending and retracting a third cylinder 12, and a carrying mechanism 14 for carrying in and carrying out the molding unit 6 relative to the driving unit 11. To fill the defined upper and lower molding spaces with molding sand, a sand-supplying device 34, which just illustrates one example of it, is provided. Note that the configurations of the pivoting frame 13 (which includes the third cylinder 12), the carrying mechanism 14, and the sand-supplying device 34, are not intended to limit the present invention.

The molding machine of the present invention may include a striping device (not shown) that strips the cope and drag flasks 2 and 3 from the contained upper and lower molds within the flasks, to adapt to form flaskless molds. The present invention is, however, not intended to be limited to such a molding machine, and is applicable to a molding method for forming tight-flask molds.

The match plate may be carried in and carried out between the cope flask 2 and the drag flask 3 by using any well-known shuttle (not shown).

By reference to FIG. 3, the molding unit 6 and the pivoting frame 13 will be now again described. The drag flask 3 of the flask assembly of the molding unit 6 is mounted on the left side of the pivoting frame 13. On the right side of the pivoting frame 13, the cope flask 2 is laterally and slidably mounted via guide rods (not shown). Attached to the lower end of the pivoting frame 13 is the distal end of a piston rod of a fourth, left-facing, and horizontal cylinder 16. The cope flask 2 is fixed to the fourth cylinder 16 via a connector 17 such that the cope flask 2 approaches, and separates from, the drag flask 3.

As shown in FIG. 2, the molding machine provides a support framework 18. Its plane cross section forms a substantially "C" shape, to support the driving system and its related parts. On a right-side frame of the support framework 18, the pair of the upper hydraulic cylinders (the first hydraulic cylinder system) is mounted. On the center of the left-side frame of the support framework 18, the single, hydraulic cylinder (the second hydraulic cylinder system) 10 is mounted. The distal end of the piston rod of the cylinder 10 is fixed to the lower squeeze member 9. The filling frame 8 in its vertical position is fixed to the inside of the support framework 18 via a support member 19 such that the filling frame 8 will abut the drag flask 3 when the lower molding space is defined.

Still in reference to FIG. 2, the hydraulic power unit 15 includes a piping system 25, 26, and 21 that fluidly communicates to inlets of the first and second hydraulic cylinder systems 7 and 10 to extend them by supplying oil from a hydraulic pump (source) 20. A third pipe 21 of the piping system is provided with an accumulator 22. In the third pipe 21, a first (upper) electromagnetic directional control valve 23 and a second (lower) electromagnetic directional control valve 24 are, in parallel, connected to each other to change the flow of the oil from the hydraulic pump 20 to the first and second hydraulic cylinder systems 7 and 10, respectively. Preferably, the type of both electromagnetic directional control valves 23 and 24 is a 3-position 4-port valve. A first (upper) pressure sensor 27 and a second (lower) pressure sensor 28 are provided in a first (upper) pipe 25 and a second (lower) pipe 26. They fluidly connect the electromagnetic directional control valves 23 and 24 with the inlets of the first and second cylinder systems 7 and 10. The first and second pressure sensors 27 and 28 measure the pressures of the oil in the first pipe 25 and the second pipe 26. In the first pipe 25 and the second pipe 26 the pressures of the oil correspond to those in the first hydraulic cylinder system (the upper hydraulic cylinders) 7 and the second cylinder system (the lower cylinder system) 10 when they are extended at their squeeze step. The first and second pressure sensors 27 and 28 generate output signals that correspond to their measured values. The output signals correspond to the pressures of the oil within the first and second hydraulic systems 7 and 10. The output signals of the first and second pressure sensors 27 and 28 are provided to a controller 29, which is electrically connected to electrical magnets of the first and second electromagnetic directional control valves 23 and 24. In the controller 29, a predetermined value within a range below the holding pressure of the accumulator against the oil is provided. The controller 29 sends instructions to the electromagnets of the first and second directional control valves 23 and 24 to control any changes made to them. The instructions are based on the output signals from the first and second pressure sensors 27 and 28 and the predetermined value in the controller 29.

For example, if the measurement value from at least one of the first and second pressure sensors 27 and 28 (e.g., the first pressure sensor 27) reaches the predetermined value, the controller 29 controls the first electromagnetic directional control valve 23 to stop the supply of the oil to the corresponding first hydraulic cylinder system 7. (However, if the supply of the oil to the hydraulic cylinder system is stopped, it can still be extended by some residual pressure within the oil. Reactivating the supply to the hydraulic cylinder systems of the oil that has been stopped is discussed below.)

Similarly, if the measured value from the second sensor 28 reaches the predetermined value, the controller 29 controls the second electromagnetic directional control valve 24 to stop the supply of the oil to the corresponding second hydraulic cylinder system 10.

Alternatively, if the measured value from one pressure sensor reaches the predetermined value, the controller 29 may control both the first and second electromagnetic directional control valves 23 and 24 to stop the supply of the oil to both the first and second hydraulic cylinder systems 7 and 10.

One skilled in the art may appropriately select the predetermined value within a range below the holding pressure of the accumulator 22 against the oil based on the properties of the accumulator. In response to the magnitude of the predetermined value, the controller 29 may stop the supply of the oil to either the hydraulic cylinder system 7 or 10, even if the measured values of both the first and second pressure sensors 27 and 28 reach the predetermined value. That is, if the measured values of both the first and second pressure sensors 27 and 28 reach the predetermined value, and if the measured value of one pressure sensor is greater than that of the other pressure sensor, the controller 29 may control just the one electromagnetic directional control valve that corresponds to the one pressure sensor, to stop the supply of the oil of the one corresponding hydraulic cylinder system.

With these controls, the minimum value of the pressure of the oil to be supplied to the first and second hydraulic cylinder systems 7 and 10, which drive the upper and lower squeeze members 4 and 9 to squeeze the molding sand within the upper and lower molding spaces, can be below the holding pressure of the accumulator 22 against the oil.

As shown in FIG. 2, the hydraulic power unit 15 may contain well-known hydraulic parts, e.g., depressor circuits (or valves) 30 and 31, and a check valve 32 with a pilot. In addition, numeral 33 in FIG. 2 denotes a guide rod 33.

The operation of the molding machine will now be explained. First, the first hydraulic cylinder 7 of the driving unit 11 is retracted, while the third cylinder 12 of the carrying mechanism 14 is extended to rotate clockwise the pivoting frame 13 to carry the molding unit 6 in the driving unit 11. In this pivoting motion, the second hydraulic cylinder system 10 is extended by the predetermined length, by, e.g., switching the second (lower) electromagnetic directional control valve 24, while the two cylinders 5 are retracted. The upper squeeze member 4 and the lower squeeze member 9 are then inserted into the cope flask 2 and the drag flask 3 (and the filling frame 8 abuts the drag flask 3). They oppose the match plate 1 of the flask assembly of the molding unit 6 to define upper and lower molding spaces. The second electromagnetic directional control valve 24 is then turned to stop the supply of the oil to the second hydraulic cylinder 10. Further, the supply of oil to the two cylinders 5 is also stopped by turning an electromagnetic directional control valve (not shown). Consequently, the sand-supplying device 34 supplies and blows molding sand into the upper and lower molding spaces.

The first and second hydraulic cylinder systems 7 and 10 are extended by turning the first and second electromagnetic directional control valves 23 and 24 such that the upper and lower squeeze members 4 and 9 are forced toward the match plate 1 to squeeze the molding sand within the upper and lower molding spaces. During this squeeze step, the first and second pressure sensors 27 and 28 measure the pressures within the first and second hydraulic cylinder systems 7 and 10 via those in the first and second pipes 25 and 26, as described above. The controller 29 turns the first and second electromagnetic directional control valves 23 and 24 based on the measured values and the above-mentioned predetermined value.

Now, assume a case in which the measured values of both the first and second pressure sensors 27 and 28 reach the predetermined value and the first and second electromagnetic directional control valves 23 and 24 are turned to stop the supply of the oil. Because the first and second hydraulic cylinder systems 7 and 10 have some residual pressure of the oil within it, they are continuously extended to further drive the upper and lower squeeze members 4 and 9. As a result of these extensions, if the measured values of the first and second pressure sensors 27 and 28 again are reduced below the predetermined value, the controller 29 again turns the first and second electromagnetic directional control valves 23 and 24 to reactivate the supply of the oil to the first and second hydraulic cylinder systems 7 and 10. These systems 7 and 10 are thus continuously extended.

If the supply for the oil for just one cylinder system is stopped, it can be reactivated, in a way similar to that described above.

Accordingly, if the supply of the oil for one or both hydraulic cylinder systems 7 and 10 is stopped, since it can be reactivated, the molding sand within the upper and lower molding spaces is squeezed, and thus upper and lower molds are produced.

Note that the molding machine of the embodiment of the present invention that is disclosed and shown above is just intended as an explanation, rather than being intended to limit the present invention. Those skilled in the art will recognize that many variations or modifications can be made within the sprit and scope of the present invention, which is defined by the appended claims.

The invention claimed is:

1. A match-plate molding machine comprising:

a flask assembly that includes a cope flask, a drag flask, and a changeable match plate, wherein said match plate has top and bottom surfaces on which patterns are formed;

an upper squeeze member adapted to be inserted into said flask assembly from said cope flask-side to oppose said top surface of said match plate and for defining an upper molding space, which is to be filled with molding sand, together with said cope flask and said top surface of said match plate;

a lower squeeze member adapted to be inserted into said flask assembly from said drag flask-side to oppose said bottom surface of said match plate and for defining a lower molding space, which is to be filled with the molding sand, together with at least said drag flask and said bottom surface of said match plate;

a first hydraulic cylinder system for driving said upper squeeze member to the top surface of said match plate to squeeze the molding sand within said upper molding space;

a second hydraulic cylinder system for driving said lower squeeze member to the bottom surface of said match plate to squeeze the molding sand within said lower molding space;

a hydraulic power unit for extending the first and second cylinder systems;

said molding machine being characterized in that said hydraulic power unit comprises:

a source for supplying oil;

a piping system for fluidly communicating with said first and second hydraulic cylinder systems to supply the oil from the source;

an accumulator that is provided within said piping system;

first and second electromagnetic directional control valves for controlling the flow of the oil from said source to the first and second hydraulic cylinder systems;

first and second pressure sensors located in said piping system to associate with the first and second hydraulic cylinder systems for measuring pressures of the oil within said piping system while the first and second hydraulic cylinder systems are extended, and for generating output signals that correspond to the measured values of the first and second pressure sensors; and a controller for receiving the output signals from the first and second pressure sensors, and for controlling the turning of the first and second electromagnetic directional control valves based on the received output signals and the predetermined value within a range below the pressure holding said accumulator against the oil.

2. The molding machine of any one of claim 1, wherein each of the first and second electromagnetic directional control valves is a 3-position 4-port valve.

3. The molding machine of any one of claim 1, wherein each of the first and second hydraulic cylinder systems include one or more cylinders.

* * * * *